US006606017B1

(12) United States Patent
Xu et al.

(10) Patent No.: US 6,606,017 B1
(45) Date of Patent: Aug. 12, 2003

(54) SWITCHABLE AND TUNABLE COPLANAR WAVEGUIDE FILTERS

(75) Inventors: Ji-Hai Xu, Gilbert, AZ (US); Jenn-Hwa Huang, Gilbert, AZ (US)

(73) Assignee: Motorola, Inc., Schaumburg, IL (US)

( * ) Notice: Subject to any disclaimer, the term of this patent is extended or adjusted under 35 U.S.C. 154(b) by 115 days.

(21) Appl. No.: 09/652,614

(22) Filed: Aug. 31, 2000

(51) Int. Cl.[7] ..... H01P 1/203; H01P 1/10
(52) U.S. Cl. ..... 333/205; 333/262
(58) Field of Search ..... 333/205, 235, 333/262

(56) References Cited

U.S. PATENT DOCUMENTS 5,486,797 A * 1/1996 Suzuki ..... 333/205 X
5,750,473 A * 5/1998 Shen ..... 505/210
5,808,527 A * 9/1998 De Los Santos ..... 333/205

OTHER PUBLICATIONS

Dib et al., "Coplanar Waveguide Discontinuities For PIN Diode Switches And Filter Applications", 1990, IEEE MTT–S Digest, pp. 399–402.*

Muldavin et al., "High–Isolation CPW MEMS Shunt Switches–Part 2: Design", Jun. 2000, IEEE Transactions On Microwave Theory and Techniques, vol. 48, No. 6, pp. 1053–1056.*

PCT International Search Report (4 pgs.) EPO, Nov. 26, 2001.

Peroulis D et al: "MEMS Devices for High Isolation Switching and Tunable Filtering", 2000 IEEE MTT–S International Microwave Symposium Digest. IMS 2000. Boston, MA, Jun. 11–16, 2000, IEEE MTT–S International Microwave Symposium, New York, NY: IEEE, US, vol. 2 of 3, Jun. 11, 2000, pp. 1217–1220, XP 000967335.

A. Brown et al., "Micromachined Micropackaged Filter Banks", IEEE Microwave and Guided Wave Letters, vol. 8, No. 4, Apr. 1988, pp. 158–160.

T. Martin et al., "Theoretical and Experimental Investigation of Novel Varactor–Tuner Switchable Microstrip Ring Resonator Circuits", IEEE Transactions on Microwave Theory and Techniques, vol. 36, No. 12, Dec. 1988, pp. 1733–1739.

J. Navarro et al., "Varactor–Tunable Uniplanar Ring Resonators", IEEE Transactions on Microwave Theory and Techniques, vol. 41, No. 5, May 1993, pp. 760–765.

* cited by examiner

*Primary Examiner*—Benny Lee
*Assistant Examiner*—Stephen E. Jones
(74) *Attorney, Agent, or Firm*—Robert L. King

(57) ABSTRACT

A series of switchable and tunable filters is provided. The filters are manufactured using coplanar waveguide fabrication techniques and micro-electro-mechanical (MEM) system switches. By making a MEM switch conductive to connect two portions of a filter element, a filter inductor is implemented. By making the MEM switch non-conductive, a filter capacitor is implemented. This results in smaller filters that can be either switched between a band pass filter and a low pass filter or switched between operating ranges.

19 Claims, 3 Drawing Sheets

-PRIOR ART-

-PRIOR ART-

402

600

500

SWITCHABLE AND TUNABLE COPLANAR WAVEGUIDE FILTERS

TECHNICAL FIELD OF THE INVENTION

This invention relates to the field of resonators and filters and more specifically to switchable and tunable coplanar waveguide resonators and filters using micro-electro-mechanical switches.

BACKGROUND OF THE INVENTION

A need exists for switchable and tunable filters for both wideband and multiband communication systems that are small in size, inexpensive and easy to manufacture. Prior art switchable/tunable filters use resonant ring arrangements with diodes used as switches to select filter response. These diode switches tend to be large in size and expensive. To help alleviate this problem, attempts have been made to manufacture filters using a micro-electro-mechanical system method. This leads to a switchable filter system but requires two different filter structures to be built with a diode for use as a switch to switch the signal path from one filter structure to another. Drawbacks to this design include that the process used to make these filters is complicated, that the resultant filter structure is large, and that there is interference between the two filter structures.

Another approach is to use coplanar waveguide filters. Coplanar waveguide filters are manufactured by using a substrate covered with a metal layer. The metal is etched to layout various filter configurations. While small filters can be manufactured in this manner, a switchable filter system still requires two different filters connected by a diode switch. This results in a large structure.

What is needed is a filter that can combine both coplanar waveguide filters with micro-electro-mechanical switches.

BRIEF DESCRIPTION OF THE DRAWINGS

For a more complete understanding of the present invention and advantages thereof, reference is now made to the following descriptions, taken in conjunction with the following drawings, in which like reference numerals represent like parts, and in which.

DETAILED DESCRIPTION OF THE DRAWINGS

The present disclosure discusses switchable and tunable filters that overcome the disadvantages of the prior art. Coplanar waveguide filter configurations and micro-electro-mechanical systems switch technology are combined on the same circuit to provide switchable and tunable filters. This is advantageous because device performance in coplanar waveguide structures is insensitive to substrate thickness. Also, coplanar waveguide filters with micro-electro-mechanical system switches are less expensive then prior art micro-electro-mechanical system filter banks. Additionally, in the present invention a single circuit can provide either two different filter responses selectable by micro-electro-mechanical system switches or a single filter with a tunable response.

A preferred embodiment of the micro-electro mechanical systems switch is disclosed in US patent application titled MICRO-ELECTRO MECHANICAL SWITCH, filed on Feb. 1, 2000 by Sun et al. And identified as Ser. No. 09/495,664. Further information concerning these switches is provided in US patent application titled MICRO ELECTRO MECHANICAL SYSTEM DEVICE filed on Feb. 1, 2000 by Huang et al. and identified as Ser. No. 09/495,786. These applications explain in detail how these switches are made, used and for example activated. Both of these applications are incorporated herein by reference. In order to avoid confusion no further discussion of these switches is included herein.

Figure 1:
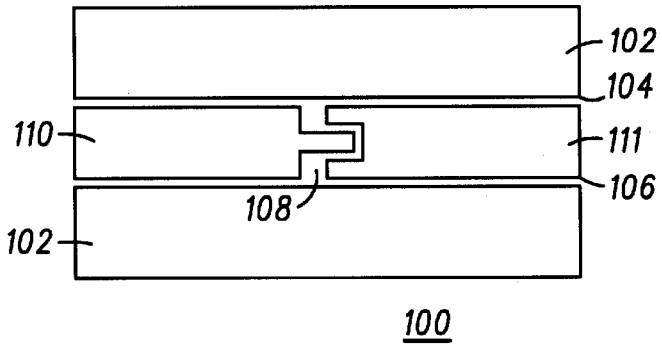
FIG. 1 illustrates a conventional interdigital capacitor.
Figure 2:
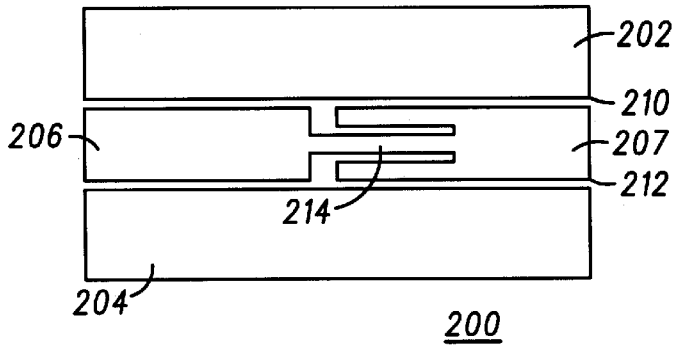
FIG. 2 illustrates a conventional interdigital inductor.

Turning to FIG. 1 and FIG. 2, these figures illustrate two basic circuit elements in coplanar waveguide structures. FIG. 1 illustrates interdigital capacitor 100. In general coplanar waveguide structures are formed on a substrate having a metal layer on top. On either side of interdigital capacitor 100 are ground strips 102. Adjacent to ground strips 102 are two gaps, a first gap 104 and a second gap 106. These gaps are formed by etching the metal layer away to expose the substrate. Typically the substrate is comprised of resistive silicon although other substrates such as glass can be used. The metal layer is typically comprised of gold or aluminum although other materials can be used. The finger structured gap 108 separates the input signal line 110 and output signal line 111.

FIG. 2 illustrates an interdigital inductor 200. Shown are ground strips 202, 204, signal input line 206 and signal output line 207. As in the interdigital capacitor, first gap 210 and second gap 212 run the length of inductor 200 to separate the ground strip from input signal lines 206 and output signal line 207. In the inductor, the input signal line 206 and the output signal line 207 are connected by the central metal line 214. This structure forms a coplanar waveguide inductor.

Figure 3:
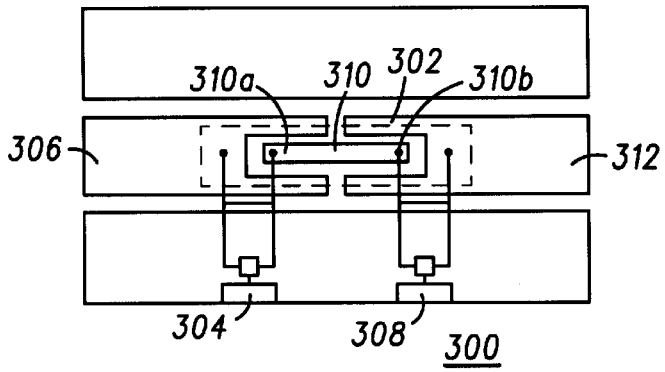
FIG. 3 illustrates a switchable filter in accordance with the teachings of the present invention.

FIG. 3 illustrates a switchable filter in accordance with the teachings of the present invention. Switchable filter 300 comprises a filter element 302. In one embodiment, filter element 302 is essentially rectangular in shape. This shape is formed by etching a rectangle in the metal layer leaving a central metal segment 310 having a first part 310*a* and a second part 310*b*. While a rectangular filter element is shown, it would be obvious to one skilled in the art that a variety of shapes can be substituted. A first micro-electro-mechanical system switch 304 is operable to connect first part 310*a* of central metal segment 310 with signal input line 306 when closed. A second micro-electro-mechanical system switch 308 connects the second part 310*b* of central metal segment 310 with the signal output line 312. If first micro-electro-mechanical system switch 304 is open, signal input line 306 and central metal segment 310 will not be connected and will be separated by the material of the substrate. This portion of filter 300 will act as a capacitor and resembles the structure in FIG. 1. If first micro-electro-mechanical system switch 304 closes, signal input line 306 and central metal segment 310 are electrically connected and a signal passes from the signal input line 306 to central metal segment 310 while passing by dielectric lines formed by the filter structure 302. When first micro-electro-mechanical system switch 304 is closed this segment acts like an inductor and resembles the structure of FIG. 2.

On the other side of filter element 302, second micro-electro-mechanical system switch 308 operates in a similar manner. If second micro-electro-mechanical system switch 308 is open, the second part of filter structure 302 operates as a capacitor. If second micro-electro-mechanical system switch 308 is closed, it operates like an inductor as seen in FIG. 2.

First micro-electro-mechanical system switch 304 and second micro-electro-mechanical system switch 308 are compatible with the coplanar configuration of coplanar waveguide filters. This means the micro-electro-mechanical switches are fabricated on the same wafer and at the same time the coplanar waveguide filter elements are formed. In prior art switchable and tunable filters, after the filter was fabricated diode switches were added. This resulted in larger structures and increased fabrication costs.

Thus, the filter response in FIG. 3 can be changed by opening or closing first micro-electro-mechanical system switch 304 and/or second micro-electro-mechanical system switch 308. For example, if both switches are closed, an inductor-inductor circuit element is formed. If both switches are opened, a capacitor-capacitor circuit is formed. If one switch is opened and one is closed, a capacitor-inductor circuit is formed. When the inductor-inductor circuit is formed, the switchable filter acts as a low pass filter. When both switches are open (a capacitor-capacitor circuit) the filter acts as a band pass filter. The series capacitors create a high pass segment but the balance of the co-planer waveguide structure inherently has an upper frequency limit thereby creating a band pass filter. In both cases, the insertion loss is very low and can be further lowered by lowering the contact resistance of the micro-electro-mechanical system switches.

Therefore, FIG. 3 illustrates a switchable filter having a compact design. With the settings of two switches, the filter behavior can be changed from a band pass filter to a low pass filter. This can be contrasted with the prior art filter which needed two separate filter structures, one low pass and one band pass and a diode switch to select which of the filters to use. The present invention allows for the use of a single filter element that can be used as two different types of filters.

Figure 4:
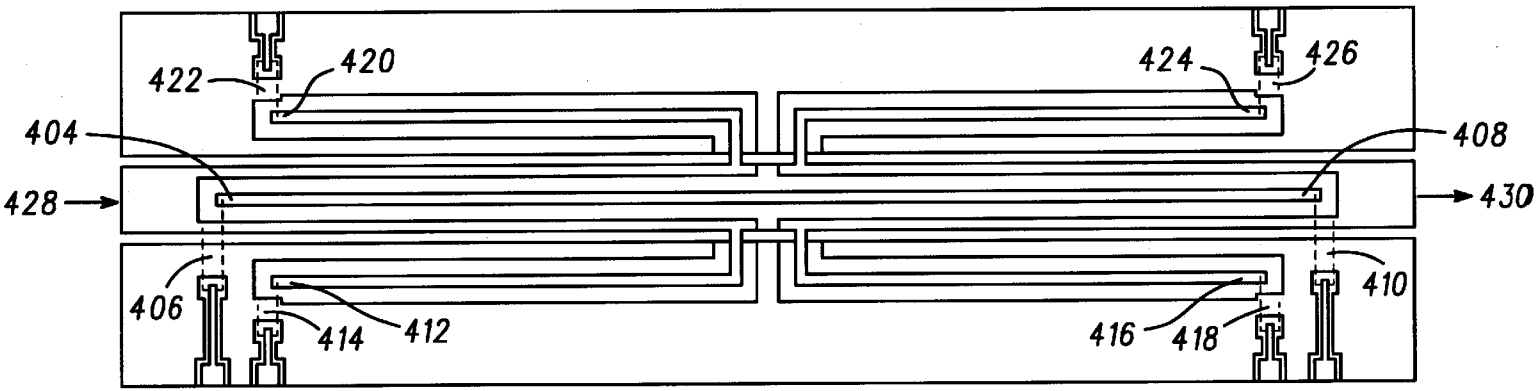
FIG. 4 illustrates a second embodiment of a switchable filter in accordance with the teachings of the present invention.

FIG. 4 illustrates an alternative embodiment of the present invention where a single switchable filter comprises multiple segments. Illustrated is a coplanar waveguide filter 402 comprising six segments connected to micro-electro-mechanical system switches.

Illustrated is a first segment 404 associated with a first micro-electro-mechanical system switch 406, a second segment 408 associated with a second micro-electro-mechanical system switch 410, a third segment 412 associated with a third micro-electro-mechanical system switch 414, a fourth segment 416 associated with a fourth micro-electro-mechanical system switch 418, a fifth segment 420 associated with a fifth micro-electro-mechanical system switch 422 and a sixth segment 424 associated with a sixth micro-electro-mechanical system switch 426. An input signal line 428 and an output signal line 430 provides a signal path through the FIG. 4 structure. The position of the micro-electro-mechanical system switches determines the characteristics of filter 402. For example, if first micro-electro-mechanical system switch 406 and second micro-electro-mechanical system switch 410 are open and the other switches are in the closed position, the filter 402 acts as a band stop filter. In a second embodiment, if the first micro-electro-mechanical system switch 406 and second micro-electro-mechanical system switch 408 are in the closed position and the other switches are in the open position, filter 402 acts as a band pass filter. While this example showed six segments attached to six micro-electro-mechanical system switches, this was for exemplary purposes only. Those skilled in the art will recognize that filters can be designed with any number of segments and switches.

Figure 5:
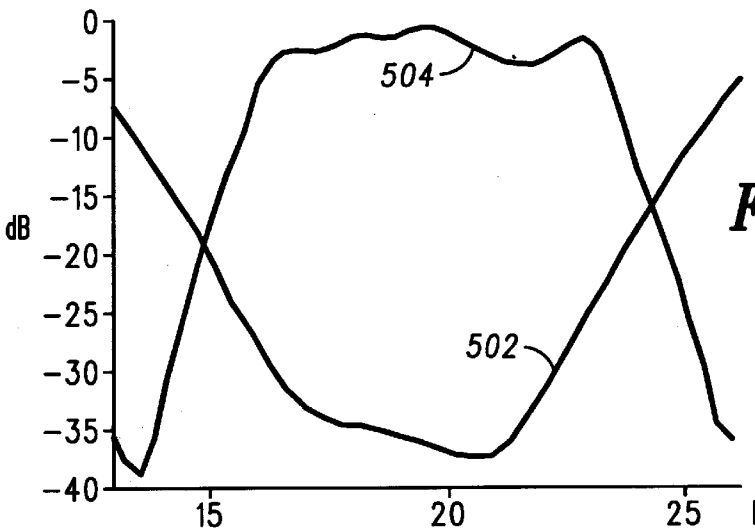
FIG. 5 is a graph illustrating the filter characteristics of the switchable filter of FIG. 4.

FIG. 5 is an exemplary graph 500 of the filter characteristics of filter 402. First curve 502 illustrates the filter response when the filter is operating as a band stop filter. Second curve 504 illustrates the filter response when the filter is operating as a band pass filter.

This embodiment illustrates that multiple filter elements can be combined to form switchable filters that operate in different frequency ranges or have different filtering characteristics. While six filter elements were used in this example, it would be obvious to one skilled in the art to combine any combination of filter elements and micro-electro-mechanical system switches together for desired filtering characteristics.

Figure 6:
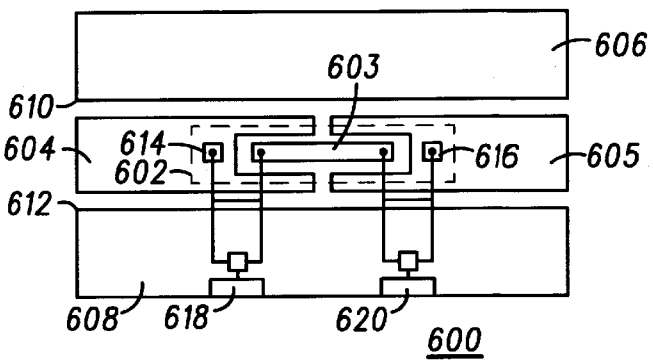
FIG. 6 illustrates a tunable filter in accordance with the teachings of the present invention.

FIG. 6 illustrates a tunable filter 600 in accordance with the teachings of the present invention. Tunable filter 600 includes tunable filter element 602 with center metal segment 603, input signal line 604, output signal line 605, ground plates 606 and 608, first gap 610, and second gap 612. Also included are first capacitor 614, second capacitor 616, first micro-electro-mechanical system switch 618 and second micro-electro-mechanical system switch 620. Capacitors 614 and 616 are formed by applying a thin layer dielectric and a top metal electrode over the signal line metal 604 and 605 as shown in detail in FIG. 7. These capacitors are processed at the same time with the micro-electro-mechanical system switches. First micro-electro-mechanical system switch 618 and second micro-electro-mechanical system switch 620 are operable to couple first capacitor 614 to center metal segment 603 and second capacitor 616 to center metal segment 603 when the switches are in the closed positions. When the switches are closed the capacitance of the circuit is increased.

In this embodiment, the central frequency of the band pass filter formed by the above design can be changed by connecting the capacitors 614 and 616 to center metal segment 603 by closing switches 618 and 620. Thus the status of the switches (closed or open) determines the central frequency of the filter.

Figure 7:
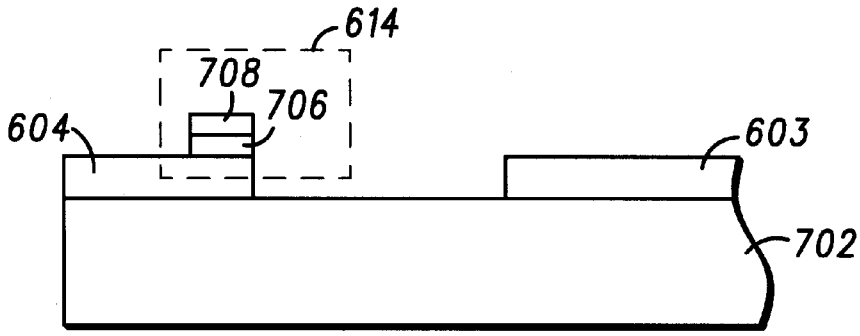
FIG. 7 is a cross-sectional view of FIG. 6 illustrating the formation of the capacitor.

FIG. 7 is a cross-sectional view of FIG. 6 illustrating in more detail the structure of capacitor 614 (capacitor 616, while not illustrated in FIG. 7, has a similar structure). Illustrated is signal input line 604, substrate 702, center metal segment 602 and capacitor 614. Capacitor 614 is formed by signal input line 604 with a thin layer of dielectric material 706 formed over the signal input layer 604. A top electrode 708 is formed over the dielectric material 706 to complete the capacitor. A micro-electro-mechanical system (not shown but illustrated in FIG. 6 as 618) is operable to connect on top electrode 708 with center metal segment 603 in order to form the filter. One advantage of capacitor 614 as illustrated in this example is that it can be manufactured at the same time as the other components of the filter such as the micro-electro-mechanical system switch.

Figure 8:
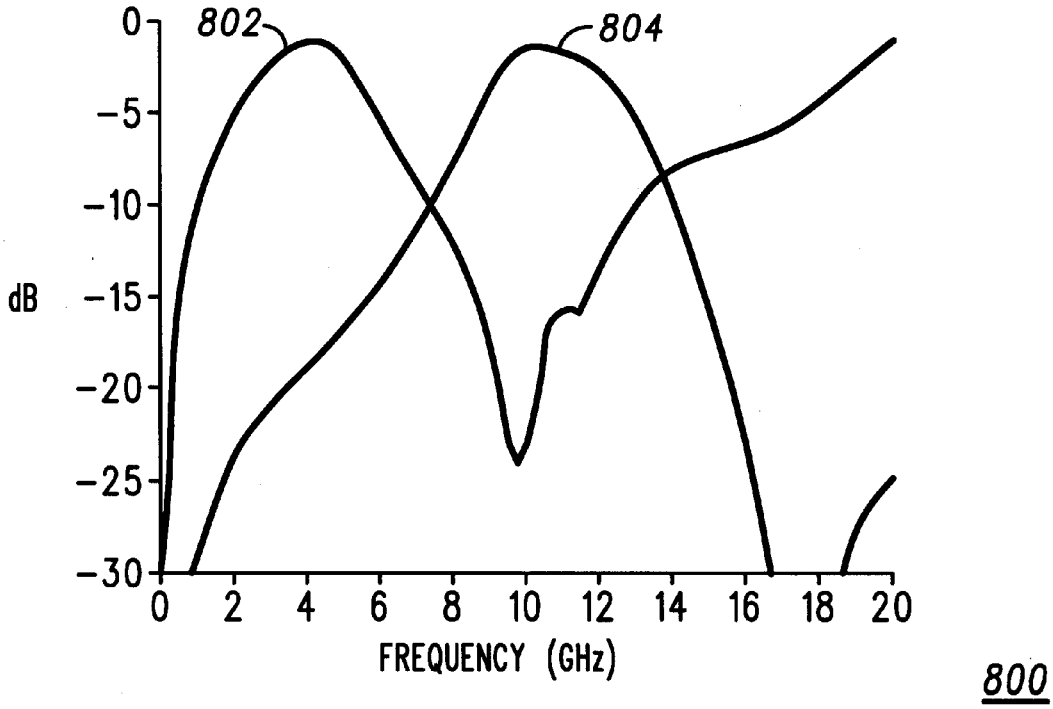
FIG. 8 is a graph illustrating the filter characteristics of the tunable filter of FIG. 7.

This behavior is illustrated in FIG. 8. FIG. 8 is a graph of the frequency response of tunable filter 600 of FIG. 6 in accordance with the teachings of the present invention. A first curve 802 is for the embodiment where both switches are closed. In this embodiment, the capacitors are coupled to the central metal segment. Second curve 804 illustrates the embodiment where both switches are open. As can be seen in FIG. 8, when the switches are open (not connected to the capacitor) the central frequency of the filter is about 10.5 GHz. When the switches are closed, the central frequency shifts to 4 GHz. The numbers shown are for illustration purposes only and will vary upon the use of different sized capacitors and filter element design.

Although the present invention has been described in several embodiments, a myriad of changes, variations, alterations, transformations and modifications may be suggested to one skilled in the art, and it is intended that the present invention encompass such changes, variations, alterations, transformations and modifications that fall within the spirit and scope of the appended claims.

What is claimed is:

1. A filter comprising a coplanar waveguide filter element associated with micro-electro-mechanical system switches, the waveguide filter element comprising a central metal segment, a signal input segment partially surrounding a first end of the central metal segment, and a signal output segment partially surrounding a second end of the central metal segment, each of the micro-electro-mechanical system switches providing a user with a tuning choice of implementing either a capacitive element or an inductive element to influence properties of the filter by selectively connecting each of the signal input segment and the signal output segment to the waveguide filter element.

2. The filter of claim 1, wherein both a bandpass filter and a low pass filter are implemented with a single coplanar waveguide filter element.

3. The filter of claim 2, wherein the filter is a band pass filter when two of the micro-electro-mechanical system switches are in a first position and the filter acts as a low pass filter when the two micro-electro-mechanical system switches are in a second position.

4. A tunable filter comprising:

at least one filter segment having a center metal segment, an input segment and an output segment, each of which is physically separate, the input segment surrounding a first perimeter portion of the center metal segment and the output segment surrounding a second perimeter portion of the center metal segment that is physically separated from the first perimeter portion;

a first filter characteristic device having a first terminal of a first micro-electro-mechanical system switch connected to the input segment and a second terminal connected to the center metal segment;

a second filter characteristic device having a first terminal of a second micro-electro-mechanical system switch connected to the input segment and a second terminal connected to the center metal segment;

wherein electrical conduction of each of the first micro-electro-mechanical system switch and the second micro-electro-mechanical system switch respectively determines whether the first filter characteristic device and the second filter characteristic device individually function as a capacitor or as an inductor, thereby determining frequency response of the filter.

5. The filter of claim 4, wherein the filter is a band pass filter when the first micro-electro-mechanical system switch and second micro-electro-mechanical system switch are in an open position.

6. The filter of claim 4, wherein the filter is a low pass filter when the first micro-electro-mechanical system switch and second micro-electro-mechanical system switch are in a closed position.

7. The filter of claim 4, wherein the at least one filter element is a single filter element comprising a rectangular shaped conductor capable of forming either a band pass filter or a low pass filter in combination with the first micro-electro-mechanical system switch and second micro-electro-mechanical system switch.

8. A filter comprising:

at least one filter element having a metal segment having a first end and a second end;

a conductive signal input line located substantially around the first end of the metal segment but not in contiguous contact with the metal segment;

a conductive signal output line located substantially around the second end of the metal segment but not in contiguous contact with the metal segment;

a first micro-electro-mechanical system switch selectively electrically connecting the first end of the metal segment and the conductive signal input line;

a second micro-electro-mechanical system switch selectively electrical connecting the second end of the metal segment and the conductive signal output line;

wherein the first micro-electro-mechanical system switch and the at least one filter element form a first filter capacitor when the first micro-electro-mechanical system switch is non-conductive and form a first filter inductor when the first micro-electro-mechanical system switch is conductive, and the second micro-electro-mechanical system switch and the at least one filter element form a second filter capacitor when the second micro-electro-mechanical system switch is non-conductive and form a second filter inductor when the second micro-electro-mechanical system switch is conductive.

9. The filter of claim 8, further comprising:

a first capacitor formed overlying the conductive signal input line and electrically connected to the conductive signal input line and the first micro-electro-mechanical system switch; and a second capacitor formed overlying the conductive signal output line and electrically connected to the conductive signal output line and the second micro-electro-mechanical system switch.

10. The filter of claim 9, wherein the filter is a band pass filter when the first micro-electro-mechanical system switch and the second micro-electro-mechanical system switch are in an open position.

11. The filter of claim 9, wherein the filter is a low pass filter when the first micro-electro-mechanical system switch and the second micro-electro-mechanical system switch are in a closed position.

12. The filter of claim 8, wherein the first micro-electro-mechanical system switch and second micro-electro-mechanical system switch are operable to connect a signal input line and a signal output line with the central metal segment.

13. The filter of claim 12, wherein the filter is a band pass filter when the first micro-electro-mechanical system switch and the second micro-electro-mechanical system switch are in an open position.

14. The filter of claim 12, wherein the filter is a low pass filter when the first micro-electro-mechanical system switch and the second micro-electro-mechanical system switch are in a closed position.

15. A switchable filter comprising:

at least one filter element having a central metal segment, a signal input segment partially surrounding a first end of the central metal segment, and a signal output segment partially surrounding a second end of the central metal segment;

a first micro-electro-mechanical system switch connected to the signal input segment and the first end of the central metal segment, the first micro-electro-mechanical system switch forming a capacitor with the signal input segment and the first end of the central metal segment when non-conductive and the first micro-electro-mechanical system forming an inductor with the signal input segment and the first end of the central metal segment when conductive;

a second micro-electro-mechanical system switch connected to the signal output segment and the second end of the central metal segment, the second micro-electro-mechanical system switch forming a capacitor with the signal output segment and the second end of the central metal segment when non-conductive, and the second micro-electro-mechanical system forming an inductor with the signal output segment and the second end of the central metal segment when conductive; and wherein electrical conduction of the first micro-electro-mechanical system switch and the second micro-electro-mechanical system switch determines the filter's characteristic.

16. The filter of claim 15, wherein the filter acts as a band pass filter when both the first micro-electro-mechanical system switch and the second micro-electro-mechanical system switch are non-conductive.

17. The filter of claim 15, wherein the filter acts as a low pass filter when both the first micro-electro-mechanical system switch and the second micro-electro-mechanical system switch are conductive.

18. The filter of claim 15, wherein multiple filter elements are used to determine the filter's characteristics, each of the multiple filter elements having one or more additional micro-electro-mechanical system switches connected thereto that each form either capacitive or inductive elements depending upon a conduction position thereof.

19. The filter of claim 15, wherein the at least one filter element and the first micro-electro-mechanical system switch and the second micro-electro-mechanical system switch are manufactured in one process, the at least one filter element and the first micro-electro-mechanical system switch and the second micro-electro-mechanical system switch forming a band pass filter and a low pass filter with a single filter element.

* * * * *